United States Patent [19]

Schneider

[11] Patent Number: 4,637,590

[45] Date of Patent: Jan. 20, 1987

[54] METHOD AND APPARATUS FOR OPENING AND CLOSING A TAPHOLE IN FURNACES

[76] Inventor: Werner Schneider, Biedenkopfer Strasse 16, D-5900 Siegen 1, Fed. Rep. of Germany

[21] Appl. No.: 779,988

[22] Filed: Sep. 24, 1985

[30] Foreign Application Priority Data

Nov. 27, 1984 [DE] Fed. Rep. of Germany ..... 3443143

[51] Int. Cl.[4] ..... C21B 7/12

[52] U.S. Cl. ..... 266/45; 266/272

[58] Field of Search ..... 266/45, 273, 271, 272; 222/590, 591, 597, 600

[56] References Cited

U.S. PATENT DOCUMENTS 4,195,825 4/1980 Ulveling et al. ..... 266/273

4,384,706 5/1983 Shirasaka et al. ..... 266/45

*Primary Examiner*—L. Dewayne Rutledge

*Assistant Examiner*—S. Kastler

*Attorney, Agent, or Firm*—Young & Thompson

[57] ABSTRACT

For the alternating opening and closing of a taphole in furnaces, especially those having high internal pressure, the taphole is sealed by a shutoff member. Thereafter a plugging gun is deployed at the opening of the taphole duct, and immediately after reopening of the shutoff member, the taphole duct is completely filled out by the plugging gun with plugging compound. After the taphole duct has been filled, but before the complete hardening of the plugging compound, a tapping rod can be driven conventionally by means of a drilling machine centrally through the plugging compound up into the furnace, and can be pulled out again for the subsequent tapping step.

2 Claims, 7 Drawing Figures

METHOD AND APPARATUS FOR OPENING AND CLOSING A TAPHOLE IN FURNACES

Figure 1:
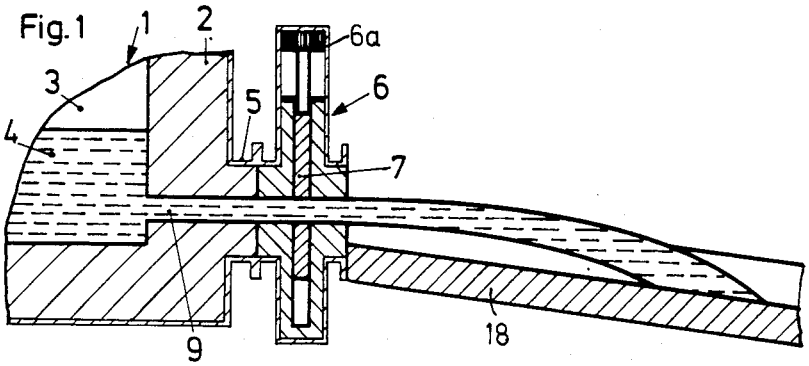

The invention relates to a method and an apparatus for the alternating opening and closing of a taphole in furnaces, especially those having high internal pressure. Among these are blast furnaces for pig iron production, shaft furnaces for direct reduction, boilers for coal gasification, for example, or low shaft furnaces for the smelting of ferro-alloys, nonferrous metals, or nonmetals, and ladle-type furnaces. During operation of such furnaces, tapholes must be opened up so that the melting charge or the by-products, e.g. slag, can be drained. Then the tapholes are sealed. The tapping sequence can range between onehalf hour and several days, in correspondence with the varying melting periods.

In case of furnaces having a relatively low operating pressure of up to about 5 bar, drilling machines are employed which drill open the tapholes at a predetermined point in time and, after opening the taphole, evade the exiting melting charge. This is done, for example, by a lateral swinging away or lifting of the drilling mounts. The machines are further provided with heat protection shielding them from damage by the exiting melting charge. The tapholes must be sealed again at the end of the tapping period, when the melting charge has been entirely or partially drained off. Plugging machines are utilized for this purpose, which are moved from a resting position into the plugging position and are forced against the taphole. During this process, the tip of the plugging gun travels through the draining melting charge. If the mouthpiece tip is damaged by the melting charge, the tapholes cannot be plugged, and the mouthpiece tip must be replaced. This causes time delays.

The tapholes are customarily opened with drilling devices which are also known from rock drilling installations. However, the drilling devices are correspondingly modified for the special conditions, for example the great heat in the tapping zone.

Drilling crowns having diameters of 50–100 mm are generally utilized. The diameter depends on the type of melt and the pressure within the furnace. In case of low furnace pressure, large holes are drilled, in case of a higher pressure, smaller holes are bored.

Various drilling methods have been known. In the so-called two-stage drilling method, the taphole, at the instant of tapping desired, is predrilled with a drilling crown, and subsequently knocked through with a smooth bar. The relatively expensive drilling crown can be reused. In the so-called single-stage opening method, complete penetration by drilling is performed with an inexpensive crown.

Both methods have the drawback that a more or less long period of time is required for the drilling operation. It happens that the drilling crown is burnt out and must be exchanged. It is also possible for the drill rod to get stuck in the taphole so that it can no longer be retracted and must be burnt out with an oxygen lance.

Furthermore, the so-called counterblow drilling method is known wherein, several minutes after plugging of the taphole, a rod is driven into the not yet completely hardened plugging compound, up into the melting charge. The forward end of the rod melts away in the furnace, the rod itself, however, remains in the taphole and is knocked out again only at the time of desired tapping. In case of low shaft furnaces, the tapholes are likewise drilled and plugged. In other cases, the taphole is burnt open with oxygen lances or electrodes. This is necessary in case the melting charge has "frozen" within the taphole and then can no longer be drilled. For sealing these holes, it is sufficient in most cases to throw shot in front of the taphole opening to stop the melt flow so that a plugging device can be dispensed with.

Also, slide closures have been known, attached underneath foundry ladles to block and regulate the efflux of liquid steel. Similar slides are also used at the bottom tap of electric furnaces, as a slide closure at converters, and as distributor slides in continuous casting installations.

The conventional tapping techniques have the disadvantage that all methods are not suitable for furnaces or pressure vessels having high internal pressure, approximately above 5 bar, for example up to 20 bar.

The invention is based on the object of developing a method and apparatus making it possible to safely open and close, at a predetermined point in time, the tapholes in melting furnaces or pressure vessels exhibiting high internal pressure. In this connection, it is to be possible to completely fill out the tapholes, eroded by erosion and chemical wear, with plugging compound and reopen same within brief time intervals in this context, small taphole diameters, for example of merely 10 mm, should likewise be possible.

After closing of the slide, the plugging gun can be pressed with its mouthpiece without any danger against the sealed opening of the shutoff member.

Figure 2A:
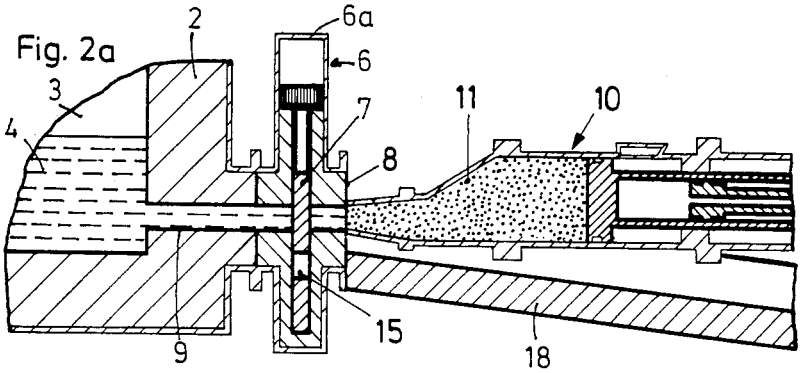
Figure 2B:
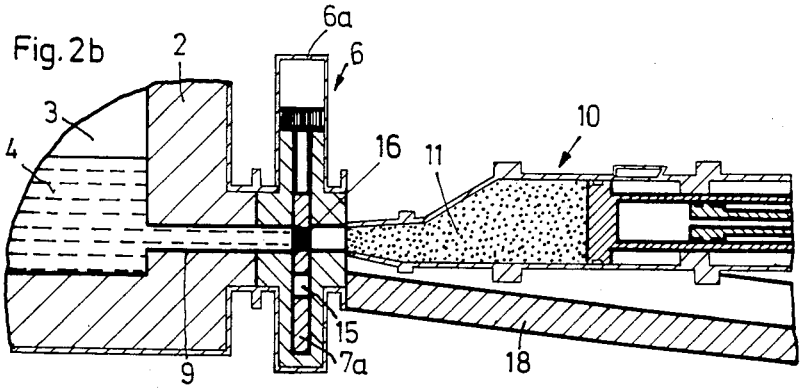
Figure 3A:
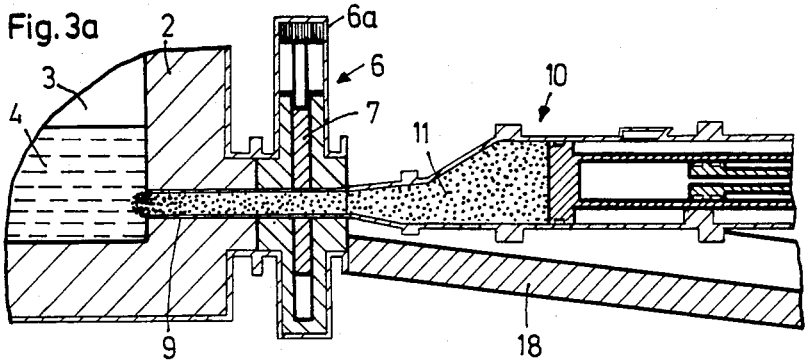
Figure 3B:
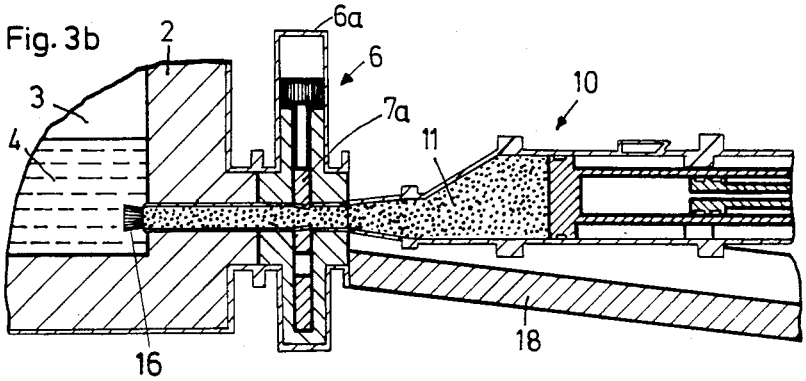
Figure 4:
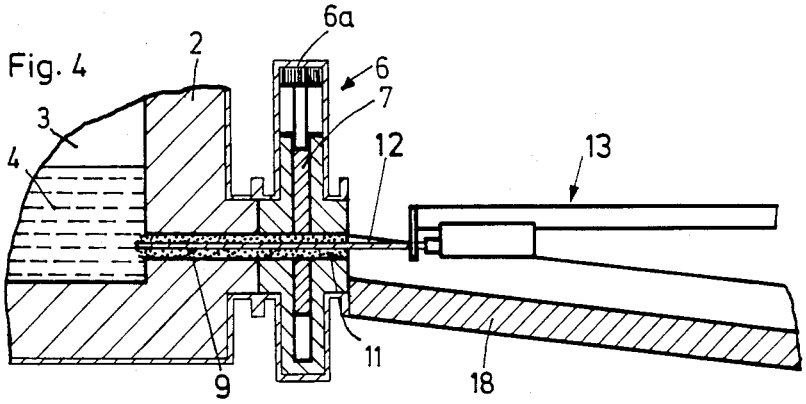
Figure 5:
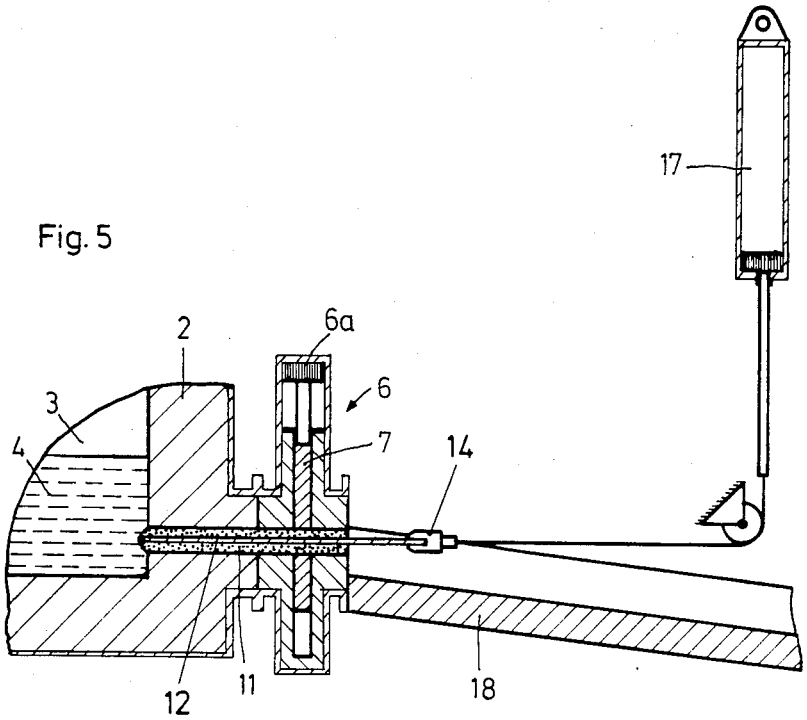

Embodiments of the invention are illustrated in the drawings, the figures showing the apparatus in the various process stages, namely:

FIG. 1 shows a smelting furnace as a pressure vessel with the shutoff slide being opened and the smelting product flowing out, FIG. 2*a* shows the same furnace with the shutoff slide being closed and the plugging gun forced in place, FIG. 2*b* shows a modified embodiment of the shutoff slide, FIG. 3*a* shows the arrangement of FIG. 2*a* with the shutoff slide being opened, after the plugging step, FIG. 3*b* shows the arrangement of FIG. 2*b* with the sealing stopper opened up, after the plugging step, FIG. 4 shows the arrangement with the tapping rod knocked in, and a drill mount, and FIG. 5 shows the arrangement with the tapping rod knocked in, and a pulling device.

A smelting furnace 1 with a refractory lining 2, designed as a pressure vessel, contains a smelting charge 4 in an inner chamber 3 under high pressure. A shutoff slide 6 with a sliding panel 7 is attached to a connecting socket 5 (FIG. 1) of the pressure vessel 1. The sliding panel 7 exhibits an opening 15 (FIG. 2*a*); it can also exhibit, in a second opening, a stopper plug 16 of a refractory material (FIGS. 2*b*, 3*b*). The side facing away from the smelting furnace 1 is provided with a contact face 8 for a plugging gun 10 (FIGS. 2*a*–3*b*), filled with plugging compound 11. After the plugging step, i.e. after filling a tapping duct 9 with plugging compound 11 (FIG. 4), a tapping rod 12 is driven by means of a drilling machine 13 into the not yet entirely hardened plugging compound 11. At the instant of desired tapping, the rod 12 can be pulled out again with the drilling machine 13 or with a separate extracting device 14 (FIG. 5), which can be activated by a pressure medium cylinder 17.

Having briefly described the structure of the apparatus, the following description will address itself to its mode of operation.

FIG. 1 shows the tapping phase. The smelting charge 4 flows under high pressure from the tapping duct 9 into a pouring spout 18. The closing slide 6 is opened. For ending the tapping step, the sliding panel 7 is shifted by means of a pressure medium cylinder 6*a* of the closing slide 6 so that the tapping duct 9 is sealed off, as shown in FIG. 2*a*. The plugging gun 10 is brought into contact with the deployment surface 8. After reopening of the closing slide 6, the tapping duct 9 can be filled with plugging compound 11 by the plugging gun 10 (see FIG. 3*a*). During this step, the smelting charge 4 recedes into the furnace 1. After a short time, once the plugging compound 11 has been hardened so that it withstands the internal pressure of furnace 1, the plugging gun 10 is swung back into its rest position. Before the plugging compound 11 has hardened completely, a tapping rod 12 is driven in by means of the drilling machine 13 (FIG. 4). The tapping rod 12, at the instant of desired tapping, is extracted again by means of the drilling machine 13, which latter can be a reciprocating percussion-type drilling machine, or by means of the separate pulling device 14 (FIG. 5). Tapping takes place through the taphole defined by the tapping rod 12, which is gradually enlarged by the smelting product up to the diameter of the original tapping duct 9.

FIGS. 2*b* and 3*b* show a modification. The sealing stopper 16 is seated in a further bore of the blocking slide 7, this stopper being urged back into the furnace 1 upon activation of the plugging gun 10 (FIG. 3*b*). In this case, the sliding panel 7*a* of the sealing slide 6 need not first be returned into its open position, as in the process step of FIG. 3*a*. The smelting charge still present in the bore 15 of the sliding panel 7*a* can be removed via a bore, not shown, in the housing of the closure slide 6, which latter, by the way, can be constructed to be foldable so that it opens up to make the sliding panel 7 or 7*a* accessible. The structural details are not illustrated inasmuch as the schematic drawings are to depict the method and the apparatus in principle.

I claim:

1. A method for the alternating opening and closing of a taphole in furnaces having high internal pressure, comprising the following process steps:

sealing the taphole duct by a closure member;

deploying a plugging gun at the opening of the taphole duct, reopening the closure member, and immediately after reopening the closure member, completely filling the taphole duct with plugging compound by means of the plugging gun.

2. A method according to claim 1, in which, after filling out of the taphole duct, but before the complete hardening of the plugging compound, driving a tapping rod by means of a drilling machine centrally through the plugging compound up into the furnace; and pulling out the tapping rod for the subsequent tapping step.

* * * * *